US005097104A

United States Patent [19]

Weichert

[11] Patent Number: 5,097,104

[45] Date of Patent: Mar. 17, 1992

[54] CONTACT ARRANGEMENT FOR AN ELECTRICAL SWITCHING DEVICE ESPECIALLY FOR A CONTACTOR

[75] Inventor: Hans Weichert, Gränichen, Switzerland

[73] Assignee: Sprecher & Schuh AG, Aarau, Switzerland

[21] Appl. No.: 580,600

[22] Filed: Sep. 11, 1990

[30] Foreign Application Priority Data

Oct. 4, 1989 [CH] Switzerland ..... 03620/89

[51] Int. Cl.[5] ..... H01H 9/30; H01H 33/04

[52] U.S. Cl. ..... 200/144 R; 200/147 R

[58] Field of Search ..... 200/144 R, 144 C, 147 R, 200/147 A, 147 B, 148 C; 335/201

[56] References Cited

U.S. PATENT DOCUMENTS

| | | | |
|---|---|---|---|
| 3,564,176 | 2/1971 | Fechant | 200/144 R |
| 4,237,355 | 12/1980 | Fechant et al. | 200/147 R |
| 4,472,613 | 9/1984 | Koller et al. | 200/144 R |
| 4,618,748 | 10/1986 | Mueller | 200/144 R |

FOREIGN PATENT DOCUMENTS

| | | |
|---|---|---|
| 070413 | 1/1983 | European Pat. Off. . |
| 079978 | 6/1983 | European Pat. Off. . |
| 3302884 | 8/1983 | Fed. Rep. of Germany . |

*Primary Examiner*—J. R. Scott

*Attorney, Agent, or Firm*—Sandler, Greenblum & Bernstein

[57] ABSTRACT

A contact arrangement provided for an electrical switching device, particularly for a contactor or protective relay, includes a stationary contact element and a movable contact element. The stationary contact element essentially consists of an elongated current lead-in member, at the end region of which there is affixed a contact member. At this contact member there is adjacently arranged an arc guiding element which is supported at the elongated current lead-in member, but is electrically conductively connected to the current lead-in member solely at an end portion thereof. At the surface or side facing away from the elongated current lead-in member, the arc guiding element is provided on an end surface area confronting the contact member with a projection which is formed of ferromagnetic material and symmetrically arranged in the center of the arc guiding element. The shortest distance between the contact member and the projection is, at most, one half of the extent of the projection in the lengthwise direction of the arc guiding element. The contactor equipped with this contact arrangement can interrupt relatively high short-circuit currents and possesses a sufficiently long service life.

10 Claims, 3 Drawing Sheets

CONTACT ARRANGEMENT FOR AN ELECTRICAL SWITCHING DEVICE ESPECIALLY FOR A CONTACTOR

BACKGROUND OF THE INVENTION

The present invention broadly relates to circuit breakers and contactors or protective relays and pertains, more specifically, to a new and improved contact arrangement for an electrical switching device, particularly for a contactor or protective relay.

Generally speaking, the contact arrangement of the present development is of the type comprising a stationary contact element and a movable contact element, whereby the stationary contact element comprises an elongated current lead-in member, a contact member mounted at an end portion of the current lead-in member, and an arc guiding or conducting element adjacently arranged at the aforesaid contact member and defining thereat a connecting or adjoining location. The arc guiding or conducting element extends in a direction substantially parallel to the current lead-in member at least in the area of the aforesaid connecting or adjoining location and is conductively connected with the current lead-in member solely or only in close proximity to the aforesaid connecting or adjoining location. The movable contact element is provided with a current-carrying connecting piece containing a contact member and situated in a manner to oppose or face the current lead-in member as well as the arc guiding or conducting element.

In European Patent Application No. 0,079,978, published June 1, 1983 there is disclosed a contact arrangement of the aforementioned type. In this known contact arrangement the stationary or fixed contact element comprises an elongated plate-shaped current lead-in member provided with a contact member mounted at an end portion thereof and an arc conducting element adjacently arranged at the aforesaid contact member and supported in electrically insulating manner at that side of the current lead-in member facing the arc chamber.

The arc conducting element is formed of ferromagnetic material and is electrically conductively connected, solely in close proximity to the contact member, by means of two rivets with the underlying current lead-in member formed of copper. At a distance from this joining location the arc conducting element is bent away to form a right angle relative to the underlying current lead-in member.

A major disadvantage of this known arrangement is seen in the fact that the arc drawn across the gap between the separating or opening contact members in a current cut-off or interrupting operation commutates in broadsurfaced manner or even only at one side to the arc conducting element leading to arc interruption plates, then further migrates or travels along the lateral edge of the arc conducting element and thereby contacts the lateral walls of the arc quench chamber consisting of insulating material. Apart from the fact that the maximum permissible cut-off current of this known contactor is confined to a relatively low range for the aforementioned reasons, the service life of the switching device turns out to be relatively short due to arcing stress of the lateral wall of the arc quench chamber.

A further known contact arrangement for a contactor comprising a stationary contact element and a movable contact element is disclosed, for example, in German Published Patent Application No. 3,302,884, published Aug. 4, 1983. The end portion of the stationary contact element provided with a contact member is bent back in U-shaped manner. A likewise U-shaped arc conducting element formed of ferromagnetic material is adjacently arranged at the contact member, the arc conducting member being bent back beneath the contact member. The arc conducting element serves to guide the switching arc between the arc interruption plates.

In order to prevent mechanical damage to the arc conducting element heated by the switching arc, there are provided protruding ribs impressed into the arc conducting element at both lateral areas thereof. The arc obviously travels along such ribs and can thus be kept away to some extent from the insulated walls of the arc quench chamber. These ribs originating or commencing relatively far away from the contact member contribute hardly anything to shortening the dwell time of the arc at the contact member and thereby to lengthen the service life of the switching device by improving commutation of the arc to the arc conducting element. This measure still provides no satisfactory increase of the maximum permissible cut-off current and practically no adequate extension of the service life of the switching device.

A further switching device containing a stationary contact element and a movable contact element is known, for example, from European Patent Application No. 0,070,413, published Jan. 26, 1983. The movable contact piece is here somewhat extended beyond the contact member and provided with an arc shield. Beside or close to the contact member of the stationary contact element and beneath the arc shield of the movable contact element in the closed contact position thereof, there is arranged an electrically conductive projection. When the movable contact member is separated from the stationary contact member, an arc commutated by the contact members is drawn between the arc shield and the projection and extinguished. Such auxiliary electrodes do not function in low-voltage switching devices, particularly in contactors with generally relatively low arc voltage, because the electric field strength at a projection is normally not sufficiently high for igniting a commutating arc.

SUMMARY OF THE INVENTION

Therefore, with the foregoing in mind, it is a primary object of the present invention to provide a new and improved contact arrangement for an electrical switching device, especially for a contactor or protective relay, which does not suffer from the aforementioned drawbacks and shortcomings of the prior art.

Another and more specific object of the present invention aims at providing a new and improved contact arrangement for an electrical switching device which renders possible the interruption of a relatively high current in an arc quench chamber equipped with walls formed of insulating material, and allows for a corresponding long service life of the electrical switching device.

A further important object of the present invention is directed to a new and improved contact arrangement of the initially mentioned type and which ensures that contact wear remains slight even in the presence of relatively high cut-off currents, thus rendering possible a long service life of the contact elements and, therefore, an economical solution in all respects.

Yet a further significant object of the present invention aims at providing a new and improved contact arrangement for an electrical switching device and which is simple in construction and design, relatively easy to fabricate, affords highly reliable operation without being subject to breakdown and malfunction, and also requires a minimum of maintenance and servicing.

Now in order to implement these and still further objects of the present invention which will become more readily apparent as the description proceeds, the contact arrangement for an electrical switching device, especially for a contactor or protective relay, is manifested, among other things, by the features that the arc guiding or conducting element is provided at an end region thereof confronting the contact member and on the side thereof facing away from the elongated current lead-in member with a projection formed of a ferromagnetic material and symmetrically arranged relative to the center or middle of the arc guiding or conducting element, and the shortest distance between the contact member and the projection is at best or most one half the extent of the projection in the lengthwise direction of the arc guiding or conducting element.

The aforesaid projection consisting of ferromagnetic material brings about an amplification of the magnetic field generated by the current to be interrupted at the aforesaid center or middle of the arc guiding or conducting element, i.e. in close proximity to the contact member. This amplified magnetic field causes, on the one hand, the arc base or foot at the aforesaid center or middle to commutate to the arc guiding or conducting element, i.e. far away from the insulating walls of the arc quench chamber, and, on the other hand, this commutation to be sufficiently rapidly effected, in order to reduce burn-off or consumption of the contact member. This measure results in the fact that the contact arrangement is suitable for interrupting relatively high overcurrents such as short-circuit currents and still renders possible an adequately long service life of an economically advantageous switching device.

The projection can possess the shape of a spherical segment. This form is relatively simple to fabricate and can be advantageously mounted at the arc guiding or conducting element.

The projection can also possess the shape of a cylinder with or without a rounded-off projecting end of the cylinder-shaped projection. Such a form also results in relatively advantageous travel properties of the switching arc.

The width of the projection is advantageously in the range of 0.2 to 0.6 times the width of the arc guiding or conducting element. Such width ratio allows for rapid migration of the switching arc from the contact member to the projection and for reliable guidance of the arc base or foot at the aforesaid center or middle of the arc guiding or conducting element.

The height of the projection is advantageously in the range of 0.2 to 0.8 times the contact break distance or gap between the stationary contact element and the movable contact element. This projection height renders possible achieving a reliable and rapid commutation of the switching arc from the contact member to the arc guiding or conducting element.

The projection can be mounted at the arc guiding or conducting element. For this purpose, there can be selected a known soldering, brazing or welding process.

The projection is advantageously provided with a stem and possesses the form of a mushroom, whereby the stem is inserted in the arc guiding or conducting element. Such a projection can be riveted into the arc guiding or conducting element.

In a contact arrangement containing an arc guiding or conducting element formed of ferromagnetic material, the projection can be structured in one piece with the arc guiding or conducting element. This arrangement provides economical advantages.

The projection can be arranged at the arc guiding or conducting element, and the distance between the surface of the aforesaid side of the latter and an edge of the movable contact element in the open position thereof, such edge confronting the arc guiding or conducting element, continuously increases, starting from the projection, in the lengthwise direction of the arc guiding or conducting element. This arrangement of the arc guiding or conducting element provided with a projection is advantageous in that the arc rapidly migrates or travels from the projection and thereby protects the projection from thermal overload.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the construction of the exemplary embodiments of the contact arrangement has been illustrated therein as is needed to enable one skilled in the art to readily understand the underlying principles and concepts of this invention.

Figure 1:
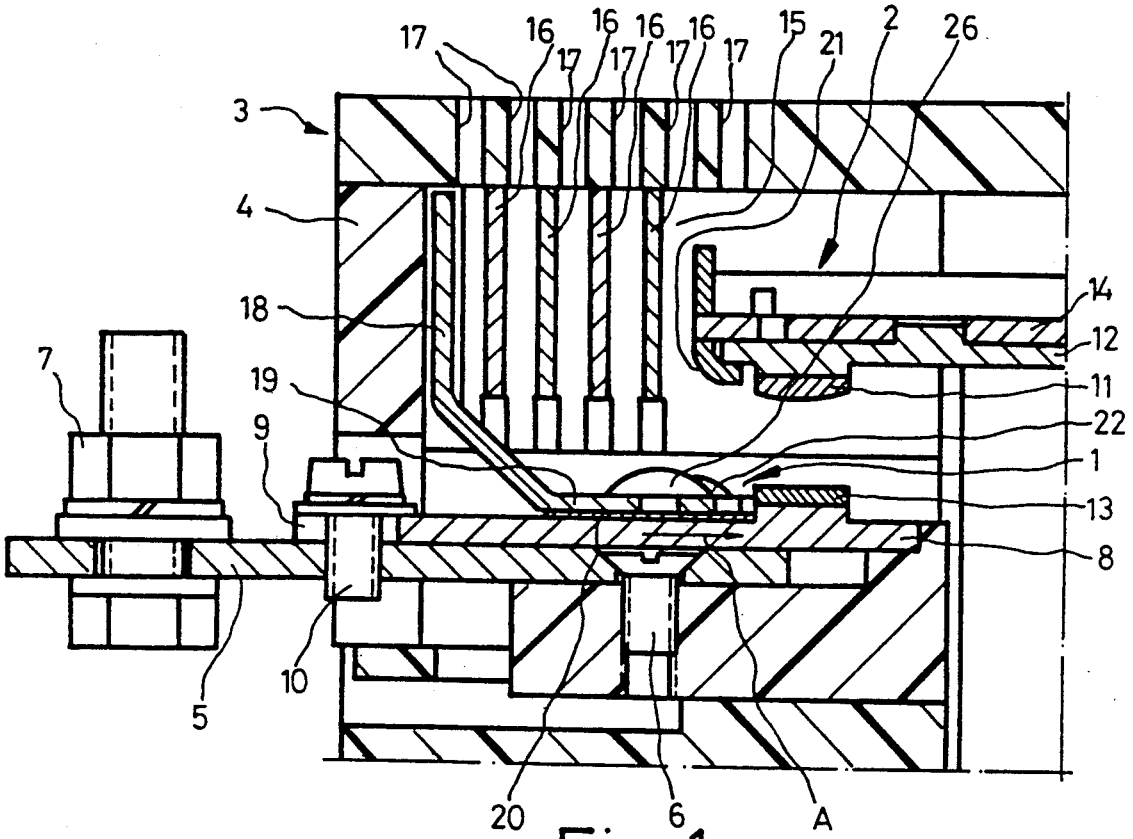
FIG. 1 is a sectional side view of a part of one of two halves of a contactor or protective relay containing the switching arrangement constructed according to the invention.

Turning attention now specifically to FIG. 1 of the drawings, a switching device schematically illustrated therein by way of example and not limitation will be seen to represent a part of one half of a contactor or protective relay having two mirror-image, mutually symmetrically arranged halves.

It is to be observed that since essentially similar structure is provided in the other half of the contactor, it will suffice to consider details of the contact arrangement shown at the one depicted half of the contactor as illustrated in FIG. 1.

The part of the depicted half of the contactor is seen to comprise a stationary contact element 1 and a movable contact element 2. The contact arrangement of the contactor is accommodated in a housing 3 formed of an electrically insulating material. Through a wall 4 of the housing 3 there extends a current guide bar or rail 5 which, for example, is formed of copper and mounted at the housing 3 by means of a screw 6. At the end or end portion of the current guide bar or rail 5 located outside the housing 3, the current guide bar or rail 5 is provided with a connection or terminal 7 for an electric conductor. At this current guide bar or rail 5 there is supported an elongated current lead-in member 8 of the stationary contact element 1, which current lead-in member 8 is detachably connected to the current guide bar or rail 5 by means of a screw 10 extending through a recess 9 located in the current lead-in member 8.

Apart from the stationary contact element 1, the contact arrangement further comprises the aforesaid movable contact element 2, on which there is affixed a contact member 11 which, by means of a connecting piece 12 consisting of an electrically conductive material, for instance copper, is connected to the other not particularly illustrated contact member of the movable contact element 2. The contact member 11 cooperates with a contact member 13 of the stationary contact element 1. The two contact members 11 and 13 consist of a suitable contact material, by way of example AgCdO. The connecting piece 12 is mounted on a carrier 14. The detailed construction or design of the movable contact element 2 structured as a contact bridge is disclosed in U.S. Pat. No. 4,472,613, granted Sept. 18, 1984 of the present assignee Sprecher & Schuh AG located in Aarau, Switzerland.

The contact arrangement is enclosed in known manner by an arc quench chamber 15 which is provided with a number of arc interruption or extinguishing plates 16 arranged relative to one another in a mutual spaced relationship and in a substantially parallel relationship. Furthermore, vents 17 are provided in the housing 3. As is apparent from FIG. 1, the end or end portion of a limb or branch 18 of an arc guiding or conducting element 19 extends substantially parallel to these arc interruption plates 16 and is arranged between these arc interruption plates 16 and the housing wall 4. This limb or branch 18 thus encloses the arc quench chamber 15.

Figure 2:
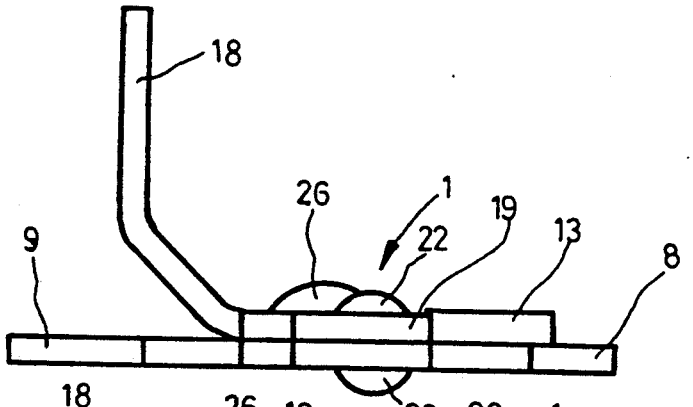
FIG. 2 is a side view of a stationary contact element.
Figure 3:
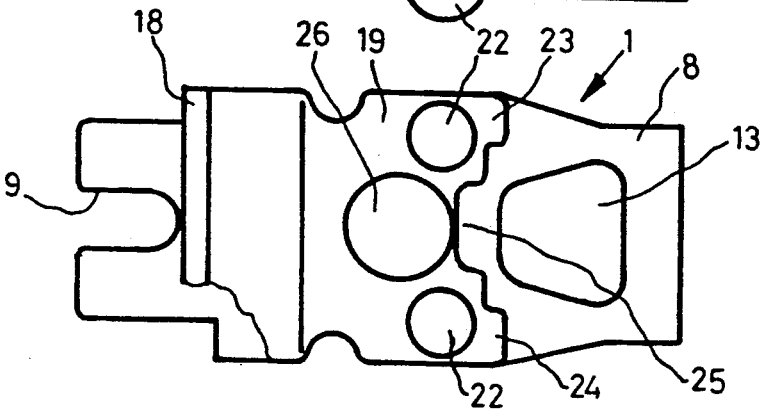
FIG. 3 is a top plan view of the stationary contact element depicted in FIG. 2.

The stationary contact element 1 depicted in a side view in FIG. 2 and in a top plan view in FIG. 3 comprises the straight current lead-in member 8 structured in the manner of a current conductor rail and consisting of a suitable electrically conductive material, by way of example copper. At its one end or end portion the straight current lead-in member 8 is provided with the recess 9 open at one side. In the region or area of the other end or end portion of the straight current lead-in member 8 there is mounted the plate-shaped contact member 13 which is connected to the straight current lead-in member 8 by means of soldering or brazing.

The arc guiding or conducting element 19 is connected to the straight current lead-in member 8, the arc guiding or conducting element 19 being located on the same side of the member 8 as the contact member 13. The arc guiding or conducting element 19 consists of a suitable material resistant to burn-off, preferably copper-plated steel. The one limb or branch of the substantially L-shaped arc guiding or conducting element 19 extends in close proximity to the contact member 13, in the opposite direction to the flow direction A of current in the straight current lead-in member 8, away from the aforesaid contact member 13 and is supported by the current lead-in member 8. Between this one limb or branch and the straight current lead-in member 8 there is arranged an intermediate layer 20 (FIG. 1) consisting of a suitable electrically insulating material. Such intermediate layer 20 can be, for example, a mica slab or lamination. The arc guiding or conducting element 19 and the current lead-in member 8 can also be electrically insulated from one another in any other suitable manner. For instance, in place of the intermediate layer 20 it is possible to apply a suitable electrically insulating coating, by way of example an oxide layer or film, to the current lead-in member 8.

The other limb or branch 18 is bent away from the aforesaid one limb or branch at an angle of approximately 90°. Between these two limbs or branches extending at right angles to one another, the arc guiding or conducting element 19 is bent at an angle of approximately 45°. This diagonal portion or location in the arc guiding or conducting element 19 is required, in order that the distance between an edge 21 of the movable contact element 2 in the open position thereof, such edge 21 facing the arc guiding or conducting element 19, and the surface of the arc guiding or conducting element 19 continuously increases, commencing at a projection or protuberance 26, in the lengthwise direction of the arc guiding or conducting element 19. The projection or protuberance 26 will be hereinafter considered in greater detail. In this manner, the arc migrating along the arc guiding or conducting element 19 can be guided to the arc interruption plates 16 while being continuously extended, i.e. without being shortened on the way.

At a connecting or joining location, the current lead-in member 8 and the arc guiding or conducting element 19 are electrically conductively connected to one another by means of rivets 22. These two rivets 22 must be formed of a suitable non-magnetic electrically conductive material, in order not to influence the effect or action of the projection or protuberance 26 formed of magnetic material. In this exemplary embodiment of the contact arrangement, there are provided two rivets 22 formed of copper. When viewed in the aforementioned flow direction A of the current, this connecting or joining location is provided upstream of the contact member 13. The one limb or branch of the arc guiding or conducting element 19 is provided at its end or end portion confronting the contact member 13 with two tongues 23 and 24, a recess 25 being located therebetween. This one limb or branch laterally wraps around the contact member 13 by means of these two tongues 23 and 24.

The arc guiding or conducting element 19 is provided at its end area or region facing the contact member 13 and on its side or surface facing away from the current lead-in member 8 with the projection or protuberance 26 formed of ferromagnetic material and symmetrically arranged relative to the center or middle of the arc guiding or conducting element 19. The shortest distance between the contact member 13 and the projection or protuberance 26 is approximately one half of the extent of the projection 26 in the lengthwise direction of the arc guiding element 19.

Figure 4:
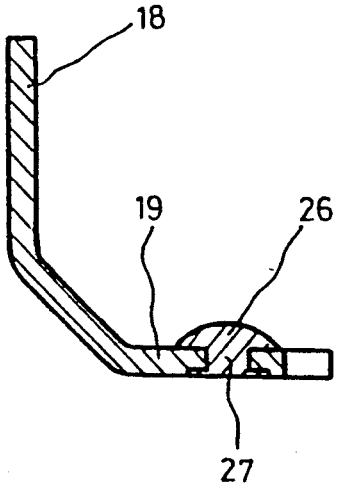
FIG. 4 is a sectional side view of an arc guiding or conducting element provided with a projection possessing the shape of a spherical segment.
Figure 5:
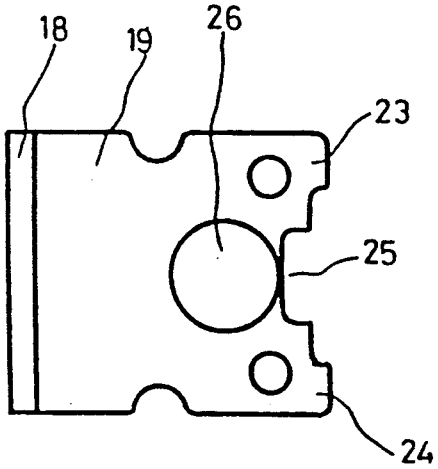
FIG. 5 is a top plan view of the arc guiding or conducting element depicted in FIG. 4.

The projection or protuberance 26 is mushroom-shaped, as is also apparent from FIGS. 4 and 5, and comprises an upper portion structured as a spherical segment. The mushroom-shaped projection 26 is thereby provided with a stem 27 which is riveted into the arc guiding or conducting element 19. The width of the projection or protuberance 26 corresponds to substantially 0.4 times the width of the arc guiding or conducting element 19. The height of the projection or protuberance 26 is equal to 0.33 times the contact break distance or gap between the contact member 11 at the movable contact element 2 and the contact member 13 at the stationary contact element 1. By virtue of the aforesaid width and height of the projection or protuberance 26, the desired amplification of the magnetic field generated by the current to be interrupted originates or develops at the projection or protuberance 26.

Figure 6:
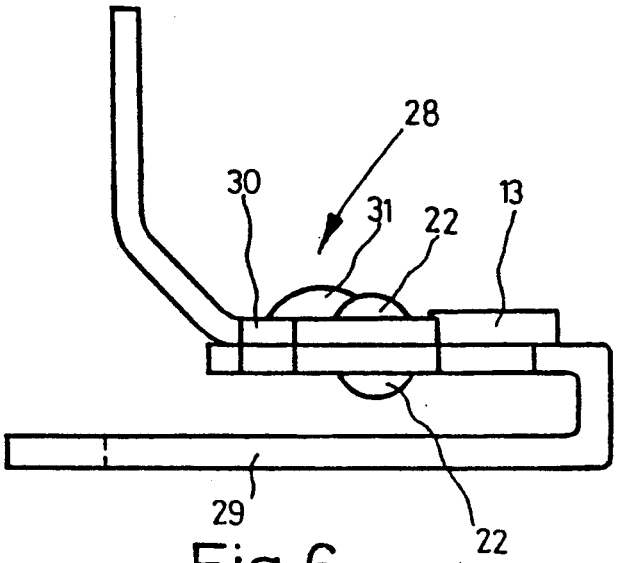
FIG. 6 is a side view of another stationary contact element.
Figure 7:
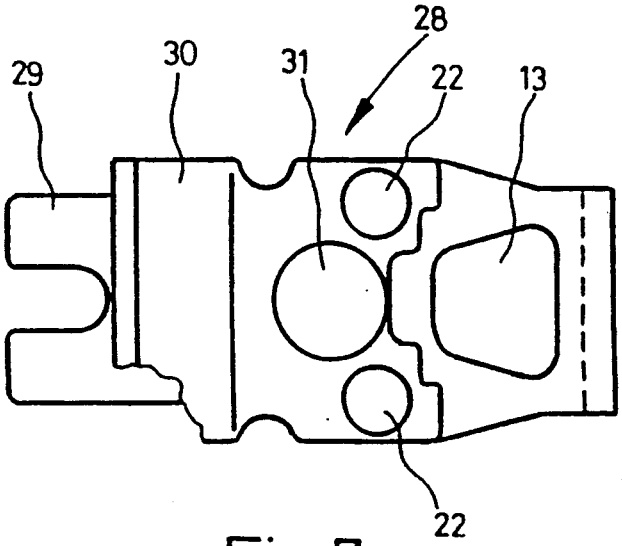
FIG. 7 is a top plan view of the stationary contact element depicted in FIG. 6.

Another stationary contact element 28 depicted in a side view in FIG. 6 and in a top plan view in FIG. 7 can be used for the hereinbefore described contactor containing a downwardly arched current guide bar or rail 5. A current lead-in member 29 in this contact arrangement is a C-shaped structure. The magnetic blow-out field acting upon the switching arc is amplified in known manner with the aid of this current guidance in the lead-in member 29. Rapid commutation of the switching arc from the contact member 13 to an arc guiding or conducting element 30 and further guidance of the commutated arc to the center or middle of this arc guiding or conducting element 30 is also accomplished in this contact arrangement by a projection or protuberance 31. This projection 31 is likewise a spherical segment in this arrangement, but is attached to the arc guiding element 30 by means of soldering or brazing.

Figure 8:
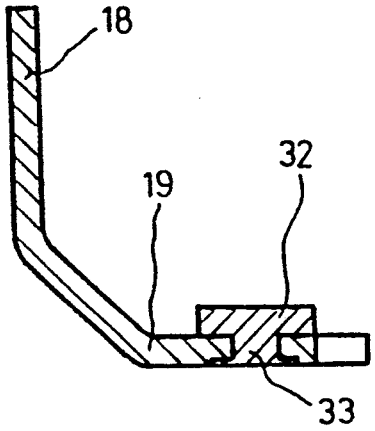
FIG. 8 is a sectional side view of an arc guiding or conducting element provided with a cylinder-shaped projection.

FIG. 8 is a sectional view of an arc guiding or conducting element 19 provided with a cylinder-shaped projection or protuberance 32 comprising a stem 33 which is riveted into the arc guiding or conducting element 19.

Figure 9:
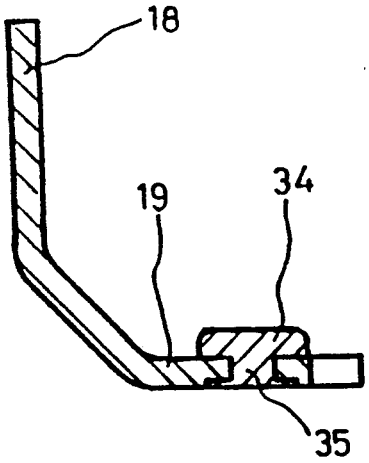
FIG. 9 is a sectional side view of an arc guiding or conducting element provided with a rounded-off cylinder-shaped projection.

In FIG. 9 there has been depicted in a sectional view an arc guiding or conducting element 19 provided with a cylinder-shaped projection or protuberance 34 having a rounded-off projecting end or end portion. A stem 35 of this projection or protuberance 34 is also riveted into the arc guiding element 19.

Figure 10:
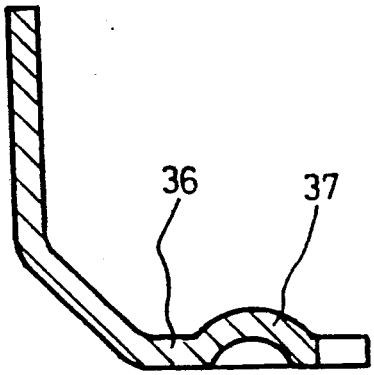
FIG. 10 is a sectional side view of an arc guiding or conducting element consisting of a ferromagnetic material and provided with a projection formed in one piece with the arc guiding or conducting element.
Figure 11:
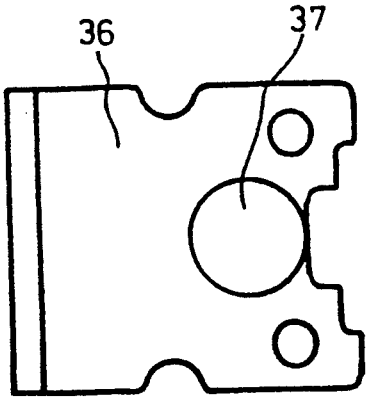
FIG. 11 is a top plan view of the arc guiding or conducting element depicted in FIG. 10.

An arc guiding or conducting element 36 depicted in a sectional side view in FIG. 10 and in a top plan view in FIG. 11 consists of ferromagnetic material. A projection or protuberance 37 is here structured in one piece with the arc guiding or conducting element 36 and fabricated by means of a press or pressing tool. The economical advantages of this construction are obvious.

The construction of the contactor hereinabove described renders possible simple interchangeability of the stationary contact element 1. When the housing 3 is opened, the stationary contact element 1 can be removed by loosening the screw 10 and replaced by a new stationary contact element 1. It is thereby unnecessary to loosen the connection between the current guide bar or rail 5 and the electric conductor connected thereto.

When the movable contact element 2 is raised from the stationary contact element 1, an arc is drawn across the gap between the contact members 11 and 13. Since the arc guiding or conducting element 19 is provided with a ferromagnetic projection or protuberance 26 and the contact member 13 is laterally enclosed by the arc guiding or conducting element 19, the arc drawn across the gap rapidly commutates to the center or middle of the arc guiding or conducting element 19. The projection or protuberance 26 formed of ferromagnetic material brings about an amplification of the magnetic field generated by the current to be interrupted, such amplification being locally effected at the projection or protuberance 26, so that the switching arc rapidly commutates from the contact member 13 to the projection or protuberance 26 and is there conducted to the arc interruption plates 16. Tests have shown that the base or foot of the arc initially commutated from the contact member 13 via the projection 26 to the center or middle of the arc guiding or conducting element 19 remains at the center or middle of the arc guiding element 19 and then travels further along the arc guiding element 19 due to magnetic self-blowing action.

The electrical separation of the arc guiding or conducting element 19 from the current lead-in member 8 by means of the insulating intermediate layer 20 renders possible that when, as viewed from the contact member 13, the base or foot of the arc is located behind the electrical connecting or joining location disposed at the rivets 22, the current flow direction in the arc guiding or conducting element 19 is opposed to the flow direction A of the current in the current lead-in member 8, so that a rapid migration of the arc to the arc interruption plates 16 is ensured. The dwell time of the arc at the contact member 13 is therefore very short, this affording the advantage of a corresponding long service life and thus also the possibility of increasing the maximum permissible cut-off current. The guidance of the commutated arc at the middle of the arc guiding or conducting element 19 precludes high thermal stress of the insulating walls of the arc quench chamber 15, so that the service life can be extended and/or the maximum permissible cut-off current of the switching device can be increased.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A contact arrangement for an electrical switching device, especially for a contactor, comprising:

a stationary contact element;

a movable contact element;

said stationary contact element comprising an elongated current lead-in member having an end portion and a predetermined lengthwise direction;

a first contact member provided on said end portion of said elongated current lead-in member;

an arc guiding element adjacently arranged on said first contact member and defining on said first contact member an adjoining location;

said arc guiding element extending at least in the area of said adjoining location in a direction substantially parallel to said predetermined lengthwise direction of said elongated current lead-in member and being electrically conductively connected with said elongated current lead-in member solely in close proximity to said adjoining location;

said movable contact element comprising a current-carrying piece;

a second contact member provided on said current-carrying connecting piece;

said current-carrying connecting piece being situated opposite said elongated current lead-in member and said arc guiding element;

said arc guiding element having an end region confronting said first contact member provided at said end portion of said elongated current lead-in member and a side facing away from said elongated current lead-in member;

said end region of said arc guiding element containing a center;

a projection formed of a ferromagnetic material and symmetrically arranged relative to said center of said end region and on said side of said arc guiding element facing away from said elongated current lead-in member;

said arc guiding element having a predetermined lengthwise direction;

said projection having a predetermined extent in said predetermined lengthwise direction of said arc guiding element; and a shortest distance between said contact member on said elongated current lead-in member and said projection being at most one half of said predetermined extent of said projection in said predetermined lengthwise direction of said arc guiding element.

2. The contact arrangement as defined in claim 1, wherein:

said projection possesses the shape of a spherical segment.

3. The contact arrangement as defined in claim 1, wherein:

said projection possesses the shape of a cylinder.

4. The contact arrangement as defined in claim 3, wherein:

said cylinder-shaped projection comprises a projecting end; and said projecting end being rounded off.

5. The contact arrangement as defined in claim 1, wherein:

said arc guiding element possesses a predetermined width; and the width of said projection being in the range of 0.2 to 0.6 times said predetermined width of said arc guiding element.

6. The contact arrangement as defined in claim 1, wherein:

said first contact member of said stationary contact element and said second contact member of said movable contact element define a predetermined contact break distance; and the height of said projection being in a range of 0.2 to 0.8 times said predetermined contact break distance.

7. The contact arrangement as defined in claim 1, wherein:

said projection is mounted at said arc guiding element.

8. The contact arrangement as defined in claim 7, wherein:

said projection is provided with a stem and comprises a mushroom form; and said stem being inserted into said arc guiding element.

9. The contact arrangement as defined in claim 1, wherein:

said arc guiding element is formed of a ferromagnetic material; and said projection being structured in one piece with said arc guiding element formed of a ferromagnetic material.

10. The contact arrangement as defined in claim 1, wherein:

said side of said arc guiding element facing away from said elongated current lead-in member constitutes a surface;

said movable contact element having an open position;

said movable contact element comprising an edge;

said edge of said movable contact element in said open position confronting said arc guiding element and defining a distance therebetween; and said distance between said surface and said edge continuously increasing, starting from said projection, in said predetermined lengthwise direction of said arc guiding element.

* * * * *